United States Patent [19]

Waldrop et al.

[11] 4,066,216

[45] Jan. 3, 1978

[54] TOOTHED PLATE FOR FACILITATING DISINTEGRATION OF CROP MATERIAL CLUMPS BY THE HAMMERMILL MECHANISM OF A TUB GRINDER MACHINE

[75] Inventors: Thomas W. Waldrop, New Holland, Pa.; John R. Flanagan, Salt Lake City, Utah

[73] Assignee: Sperry Rand Corporation, New Holland, Pa.

[21] Appl. No.: 726,711

[22] Filed: Sept. 24, 1976

[51] Int. Cl.[2] ..... B02C 13/04

[52] U.S. Cl. ..... 241/190; 241/101.7; 241/241

[58] Field of Search ..... 241/86.2, 87.1, 101.7, 241/186 R, 186.2, 186.4, 189 R, 189 A, 190, 239, 241, 243

[56] References Cited

U.S. PATENT DOCUMENTS

| | | | |
|---|---|---|---|
| 1,728,227 | 9/1929 | Bunting | 241/241 |
| 2,509,242 | 5/1950 | Miller et al. | 241/186.2 X |
| 3,186,651 | 6/1965 | Briolini | 241/186.2 |
| 3,486,704 | 12/1969 | Persky | 241/243 X |
| 3,743,191 | 7/1973 | Anderson | 241/101.7 X |
| 3,952,957 | 4/1976 | Maillet | 241/241 X |

*Primary Examiner*—Roy Lake
*Assistant Examiner*—Howard N. Goldberg
*Attorney, Agent, or Firm*—John R. Flanagan; Frank A. Seemar; John B. Mitchell

[57] ABSTRACT

For facilitating the grinding of clumps of crop material by a hammermill mechanism mounted below an opening formed in a stationary bottom wall of a tub grinder machine, an elongated plate is mounted to the bottom wall along a crop material receiving edge of the opening therein. A longitudinal marginal edge portion of the plate is bent downwardly at a slight acute angle relative to the plane of the mounting portion of the plate so as to extend into the opening generally toward the hammermill mechanism. The bent edge portion of the plate has a series of spaced apart notches or spaces formed therealong which gradually widen toward the edge of the plate so as to define a series of spaced apart, tapered and generally co-planar teeth which facilitate the ability of hammer elements of the hammermill mechanism to disintegrate crop material clumps passing through the opening over the teeth and strip disintegrated material residue from the teeth.

3 Claims, 3 Drawing Figures

TOOTHED PLATE FOR FACILITATING DISINTEGRATION OF CROP MATERIAL CLUMPS BY THE HAMMERMILL MECHANISM OF A TUB GRINDER MACHINE

BACKGROUND OF THE INVENTION

1. Field of the Invention

The present invention relates generally to a tub grinder type of machine and, more particularly, is concerned with a toothed plate adapted to be used in the tub grinder machine for facilitating disintegration of crop material clumps by the hammermill grinding mechanism of the machine.

2. Description of the Prior Art

In recent years, tub grinder machines have been realizing considerable commercial acceptance, particularly, by large cattle feeding and dairy operations where substantial volumes of ground forage products are utilized on a daily basis as feed for livestock.

The tub grinder machine conventionally has a mobile frame, a crop material receiving tub mounted on the frame, a hammermill type grinding mechanism mounted below the tub and a conveyor for discharging crop material ground by the hammermill from the machine. The tub includes a bottom wall stationarily mounted on the frame and a generally upright cylindrical side wall bounding the periphery of the bottom wall. The side wall is mounted for rotation about a generally vertical axis relative to the stationary bottom wall. The bottom wall has an opening formed therein between the pheriphery and center thereof. The hammermill grinding mechanism is mounted below the opening and includes a concave screen, a rotatably mounted shaft and a plurality of radially-extending, axially-spaced hammer elements operatively mounted thereon. The hammer elements move in generally circular paths projecting upwardly through the opening upon rotation of the shaft so as to engage and grind crop material being moved about the bottom wall and delivered to the opening therein as the side wall of the tub is rotated. The material ground by the hammer elements is discharged through the concave screen to the conveyor which is operable to deliver the ground material to a storage area or livestock feeding location as desired.

The tub grinder machine must be able to process forage crop materials which vary widely in texture, consistency, moisture content and other characteristics. Frequently, large clumps of material are present in the bulk of material dumped in the tub of the machine for grinding and when such clumps are encountered by the hammermill mechanism, they are apt to overload the same and sometimes jam and stall out the mechanism completely.

For facilitating disintegration of crop material clumps, one recent version of the tub grinder machine, such being described and illustrated in U.S. Pat. No. 3,743,191 to Robert R. Anderson dated July 3, 1973, has a series of spaced apart stationary plate-like hammers fixed upon and projecting in parallel vertical planes outwardly from an elongated plate mounted along the crop material receiving edge of the opening to the hammermill formed in the bottom wall of the tub.

Another recent version of the tub grinder machine, such being described and illustrated in U.S. Pat. No. 3,966,128 to Joseph A. Anderson et al dated June 29, 1976, has a feed control plate mounted along the crop material receiving edge of the opening to the hammermill formed in the bottom wall of the tub for movement by manual adjusting linkage between various positions which regulate the size of the opening to the hammermill and thereby control the amount of crop material which can be delivered to the hammermill at any one time.

SUMMARY OF THE INVENTION

The present invention provides an alternative approach in comparison to those of the aforementioned U.S. patents to regulation of the feeding of crop material, and especially clumps thereof, through the tub bottom wall opening of the tub grinder machine. Particularly, the present invention relates to an elongated toothed plate being mounted to the bottom wall along the crop material receiving edge of the opening therein. While the presence of the toothed plate decreases the size of the opening somewhat and tends to impede the overall flow of crop material through the opening, the generally co-planar teeth integrally formed on the plate, and especially the tapered configuration of the teeth, facilitate the ability of the hammer elements of the hammermill grinding mechanism to both disintegrate the crop material and strip the disintegrated material residue from the plate and in such manner promote aggressive feeding of crop material through the reduced opening.

More particularly, a longitudinal marginal edge portion of the plate extends into the bottom wall opening and has a series of spaced apart notches formed therealong which defined the spaced apart and generally co-planar teeth. The series of spaced apart notches gradually widen toward the edge of the plate so as to define the teeth with configurations convergently tapering toward the outer ends thereof. Furthermore, the longitudinal marginal edge portion of the plate having the teeth integrally formed therein is bent downwardly at an acute angle relative to the plane of a mounting portion of the plate. Adjustment means are provided for securing the mounting portion of the plate to the bottom wall so as to permit limited adjustment of the plate and thereby its teeth toward and away from the hammer elements of the hammermill grinding mechanism.

Other advantages and attainments of the present invention will become apparent to those skilled in the art upon a reading of the following detailed description when taken in conjunction with the drawings in which there is shown and described an illustrative embodiment of the invention.

BRIEF DESCRIPTION OF THE DRAWINGS

In the course of the following detailed description reference will be frequently made to the attached drawings in which.

DETAILED DESCRIPTION OF THE INVENTION

In the following description, right hand and left hand references are determined by standing at the rear of the machine and facing in the direction of forward travel. Also, in the following description, it is to be understood that such terms as "forward," "rearward," "left," "upward," etc., are words of convenience and are not to be constructed as limiting terms.

IN GENERAL

Figure 1:
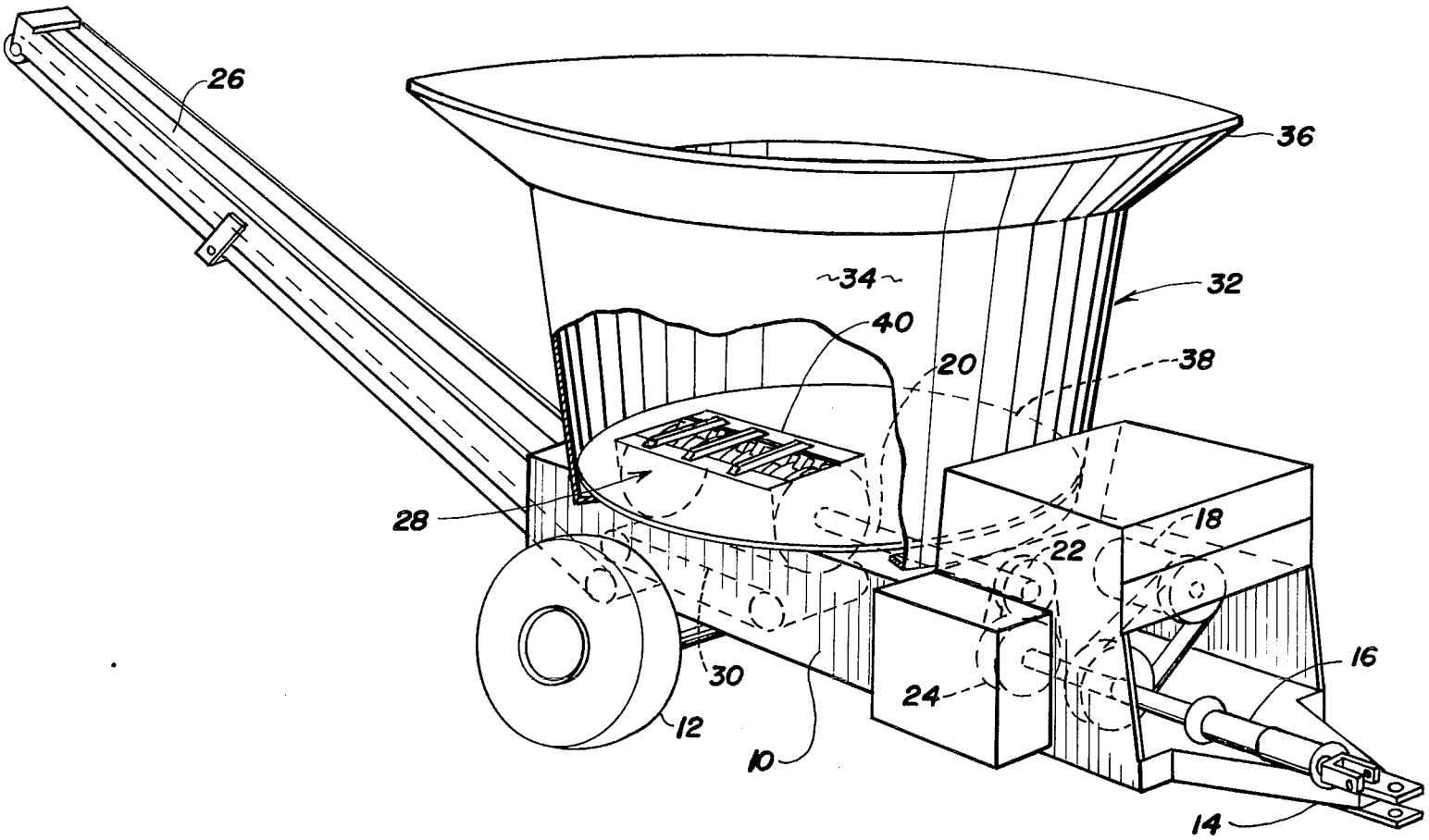
FIG. 1 is a perspective view of a tub grinder machine with a portion of the side wall of the tub thereof broken away to expose the opening in the bottom wall of the tub along a crop material receiving edge of which is mounted the toothed plate feature comprising the present invention.

Referring now to the drawings, and more particularly to FIG. 1, there is shown a tub grinder machine having a frame 10 supported and made mobile by right and left ground wheels 12 (only the left wheel being seen in FIG. 1). At the forward end of the mobile frame 10 is provided a tongue 14 adapted to be connected to the drawbar (not shown) of a tractor (not shown) for towing the machine. Also, drive means for the machine is provided at the forward end thereof, including input drive shaft means 16 adapted to be connected at its forward end to the power takeoff shaft of the towing tractor. The drive means further includes a hydraulic pump 18 operatively powered by shaft means 16 as well as supplemental drive shaft 20 which is offset from the input shaft means 16 but powered thereby through a pair of pulleys 22,24 interconnected by a suitable flexible belt or otherwise.

Extending from the rear end of the mobile frame 10 of the tub grinder machine is an elongated discharge conveyor 26 which receives ground crop material from a hammermill grinding mechanism 28 of the machine via a transfer conveyor 30 operatively mounted on the frame 10 below the hammermill mechanism 28. The discharge conveyor 26 is operative to discharge ground material either at a feed storage area, into a feed bunk or at some other desired location. It will be understood the conveyors 26,30 may be driven via suitable components (not shown) operatively connected with the drive shaft means 16, hydraulic pump 18 or the supplemental drive shaft 20, as desired; such components being conventional need not be shown and described herein for a thorough and complete understanding of the present invention.

Figure 2:
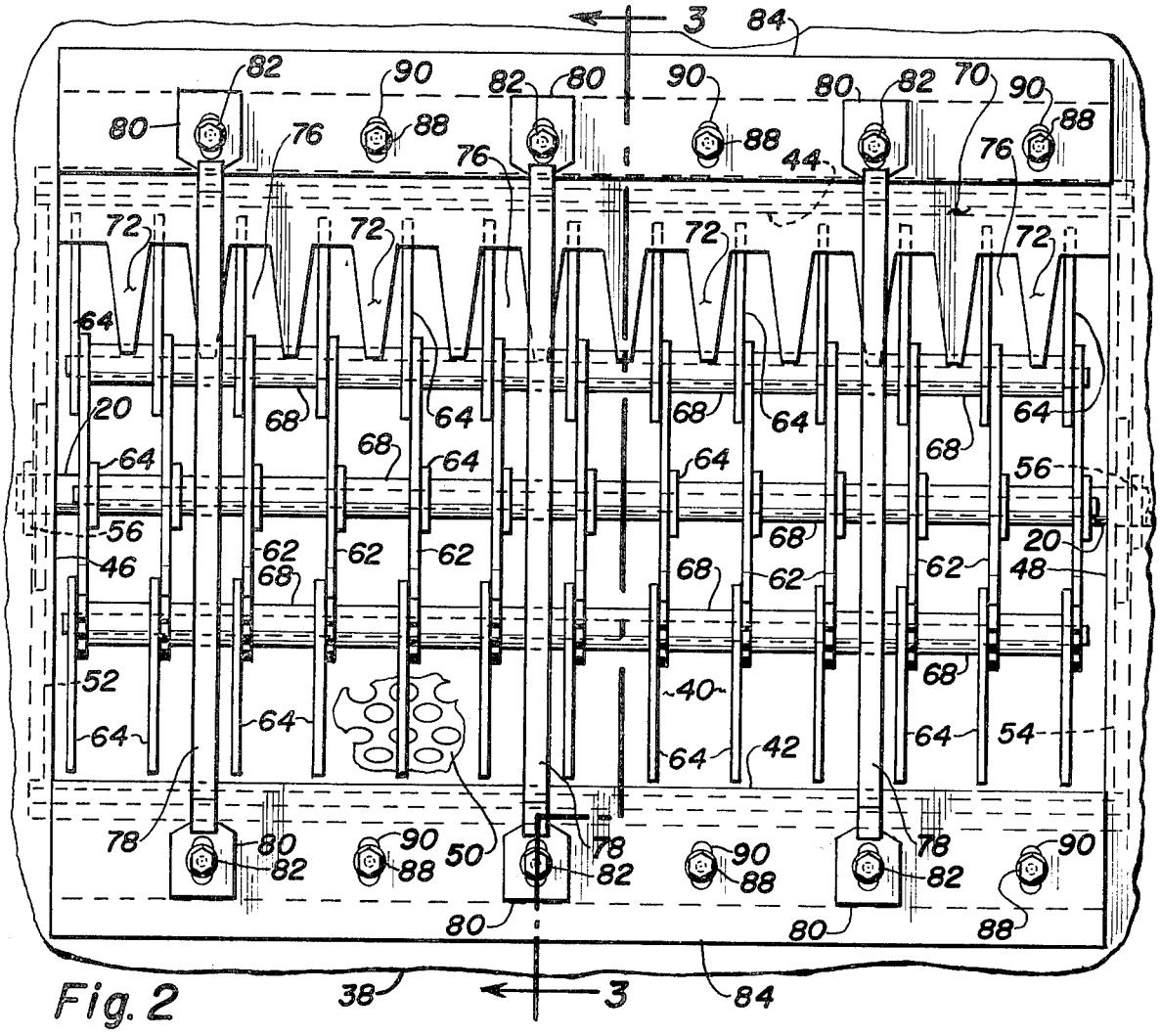
FIG. 2 is a fragmentary plan view on a larger scale than that of FIG. 1, showing the details of the hammermill grinding mechanism mounted below the bottom wall opening and the toothed plate mounted along the crop material receiving edge of the opening.
Figure 3:
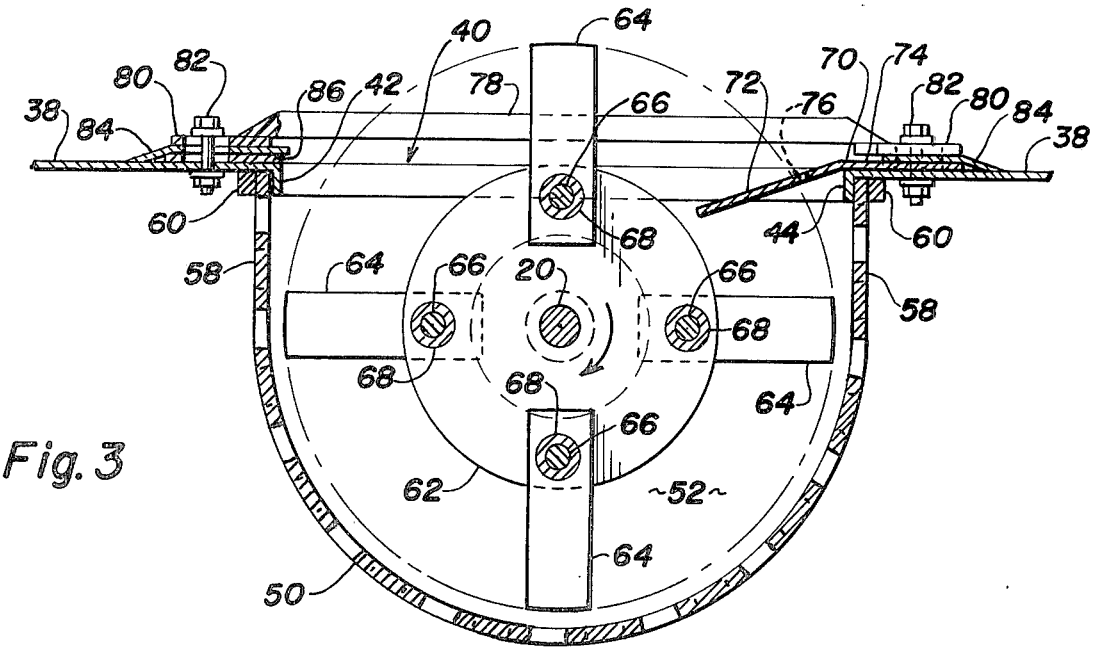
FIG. 3 is an elevational view partly in section as seen along line 3—3 of FIG. 2.

Also, the tub grinder machine includes a crop material receiving tub 32 which is supported on the mobile frame 10 and includes an upwardly extending side wall 34 which is preferably cylindrical and has an upwardly and outwardly flared rim 36 which facilitates the introduction of agricultural crop material to the tub 32 through the open upper end thereof. The side wall 34 of the tub 32 is supported upon the frame 10 by means permitting rotation of the sidewall 34 about a central vertical axis, the supporting and driving means for the side wall 34 being of conventional construction need not be shown and described herein for a through and complete understanding of the present invention. Suffice it to say that the rotation of tub side wall 34 is effected by power derived from drive shaft means 16 or supplemental drive shaft 20, as desired. The tub 32 also includes a stationary, horizontal bottom wall 38 which is in the form of a large, relatively heavy circular disc formed of steel or the like. The side wall 34 bounds the periphery of the bottom wall 38. Between the center and periphery of the circular bottom wall 38 is formed a rectangular opening 40, the longer dimension of which extends substantially radially from the central rotational axis of the tub side wall 34. The opening permits the passage of agricultural crop material from the interior of tub 32 to the hammermill mechanism 28 which is mounted to and extends below the bottom wall 38. Referring to FIGS. 2 and 3, the opposite, longer edges of the rectangular opening 40 are designated 42 and 44 and preferably terminate in downwardly extending short flanges. The opposite shorter edges or ends of opening 40 are designated 46 and 48 in FIG. 2.

HAMMERMILL GRINDING MECHANISM OF THE TUB GRINDER MACHINE

As mentioned hereinabove, the hammermill grinding mechanism 28 of the tub grinder machine, being conventional in construction, is mounted below the opening 40 formed in the bottom wall 38 of the tub 32 as clearly seen in FIGS. 2 and 3. The hammermill mechanism 28 includes a rearwardly-extending portion of the supplemental drive shaft 20, means operatively mounted on the shaft 20 which effectuates grinding of crop material upon rotation of the shaft 20 and a concave screen 50 which encompasses the shaft 20 and its grinding means below the opening 40.

The bottom wall 38 of the tub 32 supports the concave screen 50 at its upper edges. The screen 50 is as wide as the bottom wall opening 40 and is slightly larger than the opening 40. Metal plates 52,54 are disposed at the opposite ends of the screen 50 which each have a shape complementary to the cross sectional shape of the concave screen 50 and are appropriately secured at their edges to the ends of the screen 50 such as by welding or otherwise. The end plates 52,54 respectively support suitable bearings 56 through which the rearward portion of drive shaft 20 extends and is rotatably supported thereby. The axis of shaft 20 is spaced an appreciable distance below the plane of the tub bottom wall 38 and the opposing portions 58 of the screen 50 which are disposed above an imaginery horizontal plane which extends through the shaft 20 are in the form of generally vertical sections. The vertical portions 58 of the screen 50 terminate in upper edges which are connected to horizontal strips 60 which reinforce the edges and are affixed by suitable fastening means (not shown) to the flanges 42,44 of the bottom wall 38.

The grinding means of the hammermill mechanism 28, being operatively mounted on the rearward portion of the shaft 20 between its support bearings 56, includes a series of discs 62 axially spaced equi-distantly along the shaft and affixed thereto by any suitable means such as welding and a series of plate-like hammer elements 64 being pivotally mounted at their inner ends about the periphery of each of the discs 62.

Each of the discs 62 has a radius which is approximately one-half that of the lower semi-cylindrical portion of the concave screen 50 in order that the outer tips of the plurality of hammer elements 64 on each of the discs 62 will define a circular path, being shown in broken line form in FIG. 3, which is concentric with an disposed inwardly from the lower portion of the screen 50. Also, the position of the shaft 20 below the tub bottom wall 38 is such that the upper portion of the circular path of the tips of each plurality of hammer elements 64 projects a limited distance upwardly through the opening 40 and above the plane of the tub bottom wall 38.

The respective hammer elements 64 are pivotally mounted on the discs 62 by means of a plurality of elongated rods 66 which extend parallel to the shaft 20 and through a series of aligned holes formed in respective side-by-side discs 62. The rods 66 also extend through holes formed in the respective inner ends of the hammer elements 64. Spacer sleeves 68 are inserted on the rods 66 so as to extend between respective inner ends of the hammer elements 64 and the next adjacent one of the discs 62. The rods 66 are appropriately fixed at the opposite ends thereof relative to the endmost ones of the discs 62 or of the hammer elements 64 by any suitable fastening means so as to hold the entire grinding means in assembled relationship.

Preferably, four hammer elements 64 are provided for each disc 62, being displaced approximately ninety degrees one from the next about the periphery of the disc 62 with successive hammer elements 64 disposed against opposite surfaces of the disc 62 as clearly shown by full and broken lines in FIG. 3 and also shown in FIG. 2. The length of the hammer elements 64 is such that the outer tips move along a circular path, as described above, which spaces the tips an appropriate limited distance from the inner surface of the concave screen 50 so as not to engage the same but nevertheless allow the hammer elements 64 to coact with the screen 50 in a manner to force the ground crop material through the openings in the screen 50 from which it is then received by the transfer conveyor 30.

THE TOOTHED PLATE FEATURE OF THE PRESENT INVENTION

The ability of the hammer elements 64 to grind crop material being delivered to the bottom wall opening 40 as the side wall 34 is rotated, and especially to disintegrate large clumps of crop material, is facilitated by an elongated toothed plate 70 constituting the present invention which is positioned along the one long crop material receiving edge 44 of the rectangular bottom wall opening 40. The plate 70 extends in generally parallel relationship with the shaft 20 of the hammermill mechanism 28 and thus in transverse relationship to the circular paths of movement of the tips of the hammer elements 64 mounted by the discs 62. The plate 70 has a longitudinal marginal edge portion which extends into the opening 40 from the crop material receiving edge 44 thereof and is formed with a series of similar spaced apart, co-planar teeth 72 which respectively project toward the spaces between the adjacent discs 62. The plate 70 also has a mounting portion 74 along which the plate 70 is mounted to the bottom wall 38, in a manner to be described below. The longitudinal edge portion of the plate 70 which contains the teeth 72 is preferably bent downwardly at a slight acute angle relative to the plane of the mounting portion 74 of the plate 70.

The toothed plate 70 is formed from suitable steel plate material of appropriate width and thicness to enable the teeth 72 to be formed therefrom, relatively inexpensively, such as by a stamping operation or other suitable technique. After the teeth are formed, the longitudinal marginal portion is uniformly bent relative to the mounting portion 74 such that when the plate 70 is mounted along the bottom wall edge 44 the teeth 72 will project into the opening 40 and generally in the direction of the shaft 20 of the hammermill mechanism 28.

The stamping operation produces a series of spaced apart notches or spaces 76 along the longitudinal marginal edge portion of the plate 70 which define the series of teeth 72. The inner ends of the notches 76 are substantially equal in width to that of the root or inner ends of the teeth 72, as is clearly seen in FIG. 2. Further, preferably, the length of the teeth 72 is approximately three times their width at the root ends thereof and the width of the outer ends of the teeth is preferably approximately equal to one half of the width of the root ends thereof. These dimensions, in conjunction with the thickness of the teeth 72, which is shown in relative proportion to the length thereof in FIG. 3, provide the teeth 72 with sufficient strength to resist any appreciable bending of the same during the operation of the hammermill mechanism 28 wherein the moving hammer elements 64 coact with the teeth 72, when the shaft 20 and the discs 62 therewith are rotated in the direction of the arrow shown in FIG. 3, to grind crop material passing through the opening 40 over the teeth 72. During such coaction, the outer tips of the hammer elements 64 move downwardly between adjacent ones of the teeth and pass at least at a limited distance inwardly from the inner ends of the notches 76 between the teeth 72 so as to avoid metal-to-metal contact with the plate 70.

The notches 76 formed in the plate 70 flare outwardly or gradually widen toward the edge of the plate 70 such that, as mentioned above, the outer ends of the teeth 72 preferably are approximately one half the width of the inner or root ends of the teeth 72. In other words, the teeth have configurations which convergently taper toward the outer ends thereof. These configurations have been found to be beneficial in enabling the coacting hammer elements 64 and stationary plate teeth 72 to adequately cope with clumps of crop material which are frequently present in bales or stacks of such material by carrying out disintegration thereof before the clumps are allowed to enter into the hammermill mechanism 28. Also, the tapered configuration and angle of inclination of the teeth 72 facilitates the ability of the hammer elements 64 to strip disintegrated material residue from the teeth 72 and thereby promote aggressive feeding of the disintegrated material into the hammermill mechanism 28.

Referring to FIG. 2, it also will be seen that the hammer elements 64, which are made from metal plate stock, are of a thickness which is approximately one fourth of the width of the inner ends of the notches 76 between the teeth 72 of the plate 70. These relationships and those referred to above with respect to the teeth 72 have been selected for purposes of providing a level of durability and wear resistance commensurate with effective grinding of the crop material intended to be handled and ground by the hammermill mechanism 28 of the tub grinder machine.

In FIGS. 2 and 3, there is also illustrated a plurality of elongated bars 78 positioned across and slightly above the bottom wall opening 40 which are of benefit to absorb a substantial portion of a sudden shock load produced when a mass of crop material dumped into the tub 32 lands directly on the exposed opening 40. The bars 78, which form no part of the present invention, extend transversely across the opening 40 between the opposite longer edges 42,44 thereof. The bars terminate in broadened ends 80 at which the bars 78 are secured to the bottom wall 38.

Means for mounting the mounting portion 74 of the toothed plate 70 and the broadened ends 80 of the elongated bars 78 to the tub bottom wall 38 include bolts 82 which extend vertically through appropriate holes formed in the bottom wall 38 along and adjacent the opposing longer edges 42,44 of the opening 40 therein, elongated clamping plates 84 which extend along and overlie the holes adjacent the edges 42,44, a filler plate 86 which is disposed beneath the left clamping plate 84, and additional clamping bolts 88 which extend vertically through additional holes in the bottom wall 38. The toothed plate 70, broadened ends 80 of the elongated bars 78, the clamping plates 84 and the filler plate 86 all have holes formed therein which receive therethrough respective ones of the bolts 82,88, as seen in FIGS. 2 and 3. The latter holes are in the form of short slots 90 being elongated so as to extend transversely to the axis of a vertical plane through the shaft 20 to permit transverse adjustment of the plates 70,84,86 and bars 78 toward and away from the vertical plane that passes through the axis of the shaft 20. In the case of the toothed plate 70 such adjustment capability facilitates the placement of the teeth 72 of the plate 70 in optimum operating relationship to the circular paths of movement of the hammer elements 64.

The right clamping plate 84 is disposed between the right broadened ends 80 of the bars 78 and the mounting portion 74 of the toothed plate 70, the latter being flush with the marginal portion of the tub bottom wall 38 adjacent the right edge 44 of the opening 40. The left clamping plate 84 is disposed between the left broadened ends 80 of the bars 78 and the filler plate 86, the latter being flush with the marginal portion of the tub bottom wall 38 adjacent the left edge 42 of the opening 40.

In FIG. 3, it also will be seen that the outer edges of the clamping plates 84 slope downwardly toward and contact the upper surface of the tub bottom wall 38 and thereby minimize any impeding effect upon the movement of crop material across the mounting means to the opening 40. Further, in view of the fact that the drive means for the shaft 20 preferably is reversible in direction, and in view of similarity of the clamping arrangement employed at the respective opposite edges 42,44 of the opening 40, the toothed plate 70 may be exchanged with the filler plate 86, as desired, so as to dispose the toothed plate 70 on the opposite edge 42 of the opening 40.

From the foregoing description, it will be appreciated that the toothed plate 70 provides a relatively simple and inexpensive, yet highly effective, feature for enabling the hammermill mechanism 28 to efficiently process crop material, and particularly that which has clumps therein, without substantially reducing the rate at which the crop material is ground by the machine.

It is thought that the toothed plate of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. In a tub grinder machine having a mobile frame, a crop material receiving tub mounted on said frame and a hammermill grinding mechanism mounted below said tub, said tub including a bottom wall stationarily mounted on said frame, with an opening formed therein, and a generally upright cylindrical side wall bounding the periphery of said bottom wall and being mounted for rotation about a generally vertical axis relative to said bottom wall, said hammermill mechanism being mounted below said bottom wall opening and including a rotatable shaft and a plurality of radially extending, axially spaced hammer elements operatively mounted thereon which move in generally circular paths projecting upwardly through said opening upon rotation of said shaft so as to engage and grind crop material being moved about said bottom wall and delivered to said opening therein as said side wall of said tub is rotated, said machine also having drive means operable to effect rotation of said side wall and of said hammermill shaft, the improvement which comprises:

an elongated plate mounted to said bottom wall along a crop material receiving edge of said opening therein, a longitudinal marginal edge portion of said plate extending into said opening and having a series of spaced apart notches formed therealong so as to define a series of spaced apart and generally co-planar teeth which coact with said moving hammer elements to facilitate the ability of the latter to disintegrate crop material clumps passing through said opening over said teeth, said series of spaced apart notches formed along said marginal edge portion of said plate gradually widen toward the edge of said plate so as to define said teeth with configurations convergently tapering toward the outer ends thereof.

2. A tub grinder mechanism as recited in claim 1, wherein the distance between said teeth at the root ends thereof is substantially equal in width to the roots of said teeth.

3. In a tub grinder machine having a mobile frame, a crop material receiving tub mounted on said frame and a hammermill grinding mechanism mounted below said tub, said tub including a bottom wall stationarily mounted on said frame, with an opening formed therein, and a generally upright cylindrical side wall bounding the periphery of said bottom wall and being mounted for rotation about a generally vertical axis relative to said bottom wall, said hammermill mechanism being mounted below said bottom wall opening and including a rotatable shaft and a plurality of radially extending, axially spaced hammer elements operatively mounted thereon which move in generally circular paths projecting upwardly through said opening upon rotation of said shaft so as to engage and grind crop material being moved about said bottom wall and delivered to said opening therein as said side wall of said tub is rotated, said machine also having drive means operable to effect rotation of said side wall and of said hammermill shaft, the improvement which comprises:

an elongated plate mounted to said bottom wall along a crop material receiving edge of said opening therein, a longitudinal marginal edge portion of said plate being bent downwardly at an acute angle relative to the plane of a mounting portion of said plate and extending into said opening, said bent marginal edge portion having a series of spaced apart notches formed therealong which gradually widen toward the edge of said plate so as to define a series of spaced apart, tapered and generally co-planar teeth which coact with said moving hammer elements to facilitate the ability of the latter to disintegrate crop material clumps passing through said opening over said teeth and strip disintegrated material residue from said teeth.

* * * * *